US006216747B1

(12) United States Patent
Lawrence

(10) Patent No.: US 6,216,747 B1
(45) Date of Patent: Apr. 17, 2001

(54) BEAM LET-OFF APPARATUS AND A METHOD FOR LETTING OFF FILAMENTS

(75) Inventor: John Stevens Rutter Lawrence, Waynesboro, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/496,116

(22) Filed: Feb. 1, 2000

Related U.S. Application Data

(63) Continuation-in-part of application No. 09/268,363, filed on Mar. 15, 1999, now abandoned.

(51) Int. Cl.[7] ..... D03D 49/06

(52) U.S. Cl. ..... 139/110; 226/44; 242/413.6; 242/421.6; 242/421.7

(58) Field of Search ..... 139/110; 226/44; 242/413.6, 421.6, 131.1, 421.7

(56) References Cited

U.S. PATENT DOCUMENTS

| | | | | |
|---|---|---|---|---|
| 3,630,463 | * | 12/1971 | Mistcle | 242/75.43 |
| 3,650,490 | * | 3/1972 | Sunders | 242/75.3 |
| 3,680,753 | * | 8/1972 | Shaw-stewart | 226/25 |
| 4,000,865 | | 1/1977 | Gaskins | 242/75.43 |
| 4,019,700 | | 4/1977 | King | 242/131.1 |
| 4,163,180 | * | 7/1979 | Dowd | 318/6 |
| 4,407,331 | * | 10/1983 | Rehling et al. | 139/110 |
| 4,585,037 | | 4/1986 | Kimbara | 139/1 E |
| 5,259,421 | | 11/1993 | Alexander, III et al. | 139/110 |
| 5,546,993 | * | 8/1996 | Summey, III et al. | 139/110 |

* cited by examiner

*Primary Examiner*—Andy Falik
(74) *Attorney, Agent, or Firm*—George A. Frank

(57) ABSTRACT

A beam let-off apparatus capable of adjusting the tension of a plurality of filaments as they are removed from a beam through the controlled movement of a pivoting arm directed by the tension of the unwinding filaments, comprises a frame, a driven roll, 1–3 idler rolls on the frame and a dancer roll mounted on pivoting arms mounted on the frame wherein the filaments pass under and around the dancer roll through a defined wrap angle is provided.

11 Claims, 4 Drawing Sheets

BEAM LET-OFF APPARATUS AND A METHOD FOR LETTING OFF FILAMENTS

CROSS-REFERENCE TO RELATED APPLICATIONS

This application is a continuation-in-part of Ser. No. 09/268,363, filed Mar. 15, 1999 abandoned May 10, 2000.

BACKGROUND OF THE INVENTION

1. Field of the Invention

The present invention relates to a beam let-off apparatus for adjusting the tension of a plurality of elastomeric filaments as they are removed from a beam and transported to a downstream operation.

2. Description of Background Art

Attempts to control the tension of a plurality of filaments as they are taken off a beam and led to a downstream knitting or weaving machine have taken a variety of forms. U.S. Pat. No. 5,259,421 discloses a complex system which uses a rack-and-pinion dancer roll positioned by a DC drive in response to a signal from a potentiometer output. Because of the high friction and low responsiveness of this design to filament tension, this apparatus is best suited to high-tension weaving of heavy fabrics, not to low-tension use of elastomeric filaments. U.S. Pat. No. 4,000,865 discloses another apparatus comprising a complex array of lever arms and air pressure regulators. U.S. Pat. NoS. 4,585,037 and 4,019,700 disclose the use of a tension roller and a dancer roll, respectively, as sensing devices, but the geometries of the apparatus require the use of expensive proportional control of motor speeds to control filament tension.

A simple, economical, and effective apparatus is still needed to let off spandex and other elastomeric filaments from a beam in preparation for knitting, weaving, and so on.

SUMMARY OF THE INVENTION

The apparatus of the present invention for letting off elastomeric filaments from a beam comprises:

a frame;

a driven roll and an idler roll rotatably mounted on the frame for rotatably supporting a beam on and between the driven roll and the idler roll;

a dancer roll rotatably mounted between arms mounted on the frame, wherein the filaments pass under and around the dancer roll through a wrap angle in the range of 140° to 180°;

drive means for rotating the driven roll;

a switch for activating and deactivating the drive means; and means for signalling dancer roll position to the switch so that when the dancer roll is in a raised position the switch activates the drive means, and when the dancer roll is in a lowered position the switch deactivates the drive means.

BRIEF DESCRIPTION OF THE INVENTION

FIGS. 4, 5A, 5B, and 6 schematically show other embodiments of the apparatus.

Figure 7:
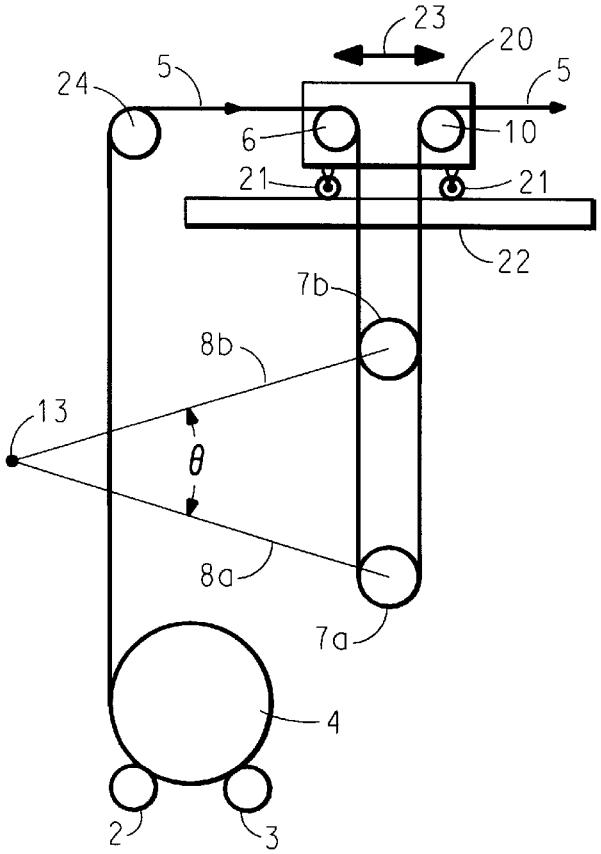

FIG. 7 shows schematically yet another embodiment of the apparatus in which two idler rolls are permitted to move horizontally in response to changes in filament tension.

DETAILED DESCRIPTION OF THE INVENTION

The apparatus and method of the present invention can be used with any continuous elastomeric filament such as spandex. As used herein, "elastomeric filament" means a continuous filament which has a break elongation in excess of 100% and which when stretched and released, retracts quickly and forcibly to substantially its original length. Such filaments include rubber fiber, spandex, polyetherester filament, and elastoester, and can be either covered with non-elastomeric fibers such as nylon, cotton or polyester or can be bare (uncovered). "Proportional control" refers to prior art systems in which the drive motors are controlled by rheostats, potentiometers, and the like.

Warp filaments are generally wound on a beam, which is a cylinder provided with end bearings and end flanges. During weaving or warp knitting, the filaments are unwound from the beam.

The present beam let-off apparatus comprises a frame, one driven roll, 1–3 idler rolls on the frame, and a dancer roll mounted on optionally counterweighted, pivoting arms mounted on the frame. It has been found that surprisingly uniform filament tension can be obtained with such an apparatus. Compared to non-elastomeric filaments, variations in downstream processing demand for elastomeric filaments (exhibited as changes in tension) are propagated relatively slowly and incrementally back to the source of the filaments because of the high stretchability of the filaments. In addition, the relatively low tensile strength of elastomeric filaments means that the total tension applied must be carefully controlled at a low level. The low-friction operation of the apparatus and the substantially vertical non-rotational motion of the dancer roll makes the present apparatus responsive to small changes in tension, so that tension is well controlled at low levels by the weight of the arm and dancer roll, and the typically small initial changes in tension as downstream demand is changed are quickly compensated for by the movement of the arm and dancer roll, not the drive motor. As a result, an expensive proportional control system is not required. Because of high elasticity of elastomeric filaments, it is advantageous for good tension uniformity that the design of the dancer arm-and-roll system allows it to release and take up considerable slack with variations in downstream demand and to make maximum use of the effect of gravity on the dancer roll and arms to maintain constant filament tension.

Figure 1:
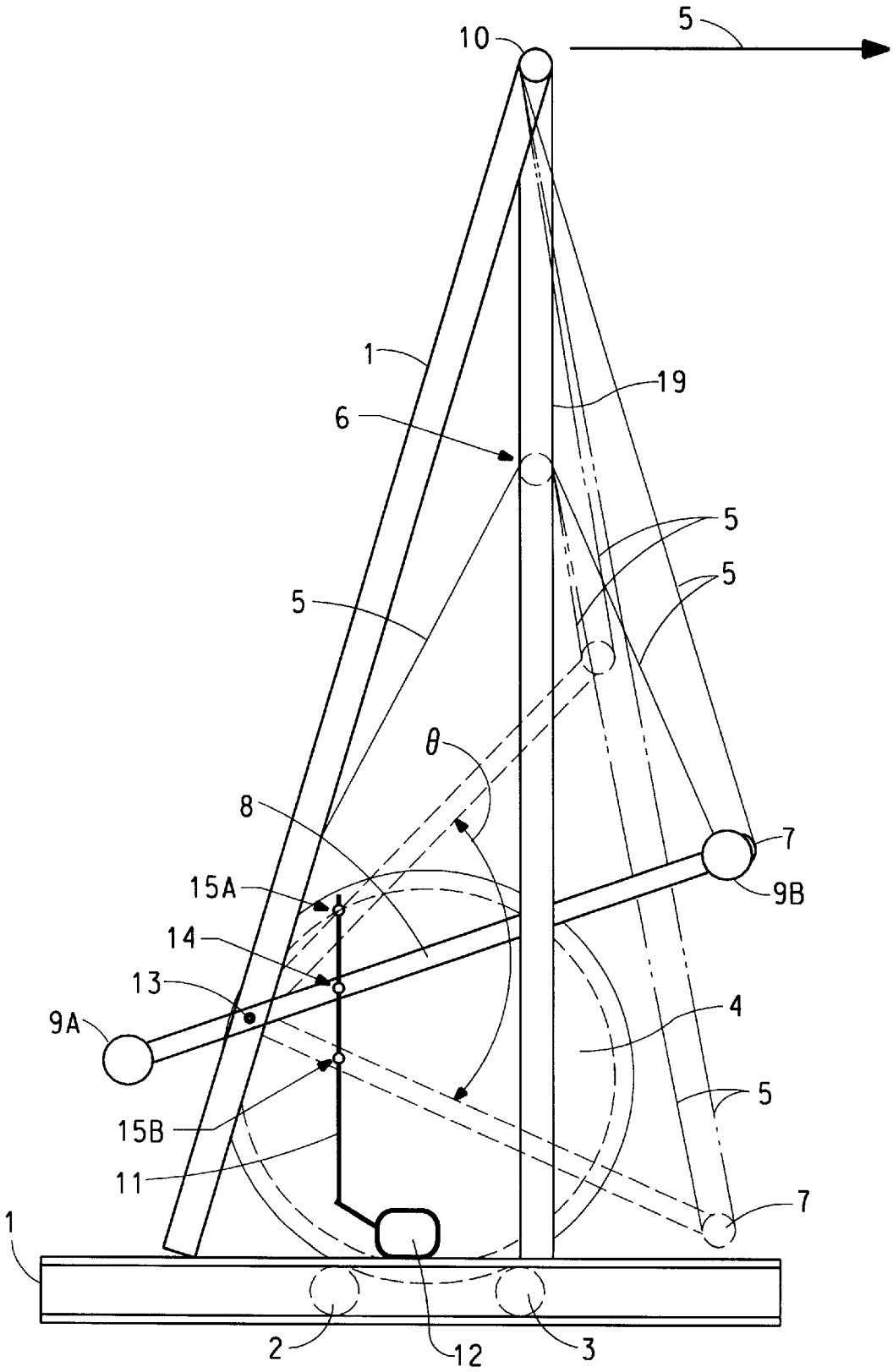
FIG. 1 shows a preferred embodiment of the apparatus of the present invention from the side.
Figure 2:
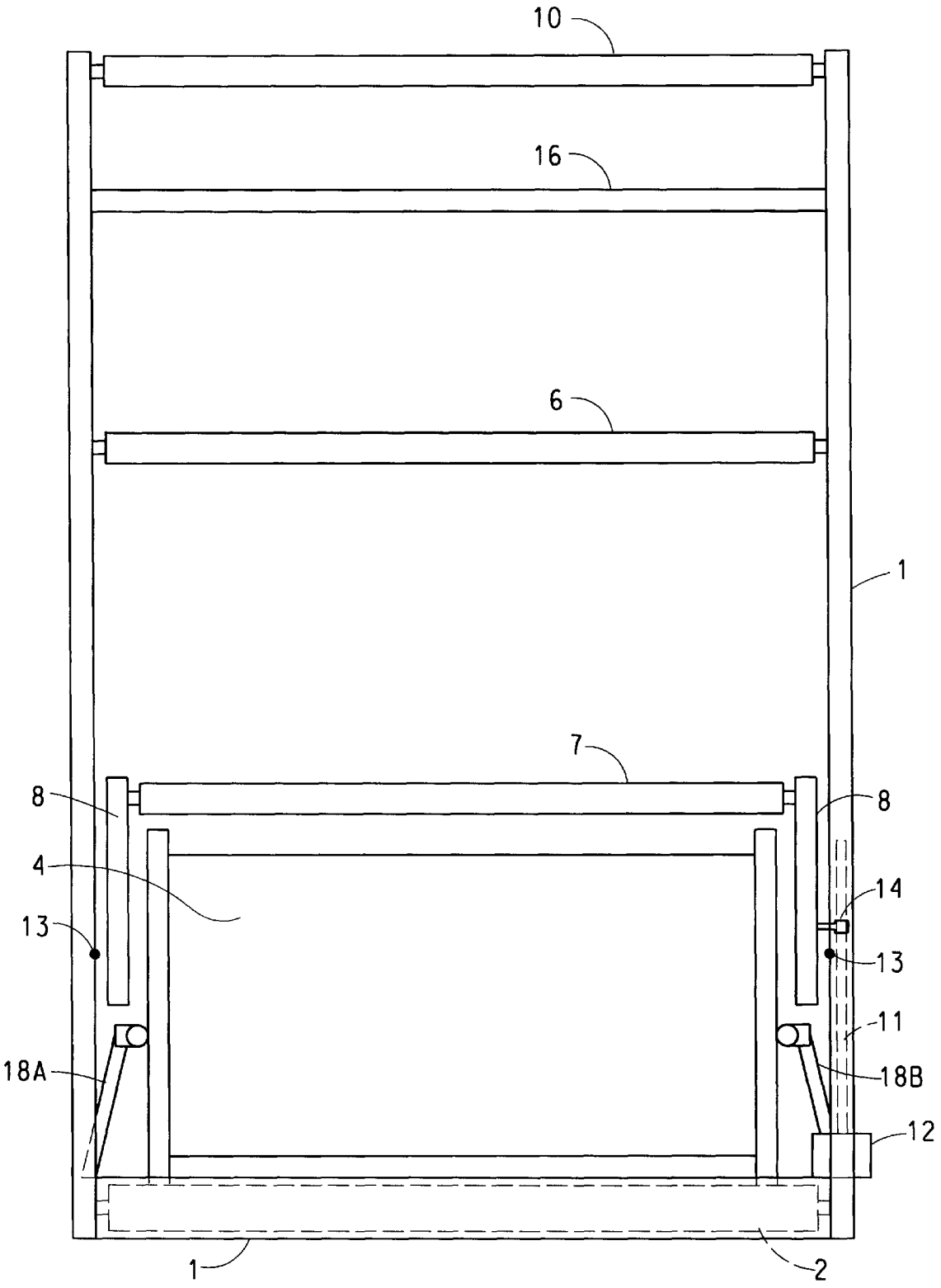
FIG. 2 shows the apparatus from the back, that is, from a position opposite from the downstream processing machine.

In a preferred embodiment of the apparatus shown in FIGS. 1 and 2, the beam is mounted low in the apparatus and, therefore, it is easy to load and unload beams (from the left in FIG. 1) and the apparatus has a low center of gravity when in use, which improves operational safety.

In FIGS. 1 and 2, frame 1 is illustrated as A-shaped sections attached to a bottom section; only one A-shaped section appears in FIG. 1. Driven roll 2 and first idler roll 3 are rotatably mounted in the bottom part of frame 1. Beam 4 is supported on rolls 2 and 3 so that when roll 2 is rotated by a drive means, for example an electric motor (not shown), the beam is also rotated, unwinding filaments 5. Alternatively, roll 3 can be driven and roll 2 can be an idler roll, but the former arrangement is preferred in order to minimize damage to the driven roll as the beam is loaded (from the left in FIG. 1) into the apparatus. Typically, 5 is a plurality of filaments in the form of a threadsheet; in FIG. 1 it is shown as a single line.

Idler roll 6 (the second idler roll in this embodiment) is rotatably mounted between the A-shaped sections of frame 1 above the driven roll and the first idler roll, for example as illustrated in FIGS. 1 and 2. Dancer roll 7, which is also an idler roll, is rotatably mounted between a pair of optionally counterweighted arms 8 so that the dancer roll is higher than rolls 2 and 3 and lower than roll 6 and preferably so that its motion when arms 8 pivot is substantially vertical. Arms 8 are pivotably mounted on frame 1 at pivot points 13. Only one arm 8 is shown in FIG. 1, but it is shown in three positions: at the top, bottom, and approximate middle of its pivoting range; filaments 5 are also shown approaching and leaving dancer roll 7 at three positions. The geometry of the apparatus, and in particular the length of arms 8 and magnitude of angle θ through which arms 8 can pivot, are chosen so that as filaments 5 approach and leave dancer roll 7, the fibers do not become entangled with the beam or the apparatus itself.

Weights 9A and 9B can be attached to arms 8 to adjust the tension applied to the filaments by the weight of arms 8 and roll 7. Simple weights such as washers can be used, as well as calibrated measuring weights for more accuracy, or the design of the arms themselves can provide the desired weight. Independently attached weights are preferred because the counterweight is then adjustable. Roll 10 (the third idler roll in this embodiment) is mounted between the A-sections of frame 1 at or adjacent to the top of the frame, above second idler roll 6. The A-section of frame 1 can be extended upward so that roll 10 can be mounted even higher, or roll 10 can be mounted lower than roll 6 but higher than dancer roll 7. Brace 16 (see FIG. 2) can be used to stabilize the upper ends of the A-sections.

In order to make maximum use of the weight and pivotal motion of arms 8 and roll 7 to control filament tension at the low tension levels used for elastomeric filaments, it is preferred that the non-rotational motion of roll 7 be substantially vertical (that is, within about 20° of vertical) in response to changes in such tension. There are several ways to make the motion of roll 7 vertical or nearly so, and combining such ways can be advantageous. One way is to make arms 8 pivot about a substantially horizontal position. Another is to make arms 8 as long as practical and angle θ as small as practical. Yet another way is to use a wrap angle, ψ, representing the directional change that filaments 5 undergo as they pass under and around dancer roll 7 (and also the contact angle of filament 5 with roll 7), in the range of about 140° to 180°, preferably 160° to 180°. Wrap angle is defined as the angle formed by the lines drawn from the center of the dancer roll and the two contact points of the filament on the roll. Still another way is to have leg 19 of the A-section of frame 1 positioned so that filaments 5 pass substantially vertically from roll 6 to roll 7 and for roll 10 to be offset above roll 6 by about the width of roll 7 so that filaments 5 pass substantially vertically from roll 7 to roll 10.

Another way of making the motion of roll 7 substantially vertical in response to changes in filament tension is to permit rolls 6 and 10 to move horizontally, also in response to changes in filament tension. One way to do this is illustrated in FIG. 7. (For sake of clarity, not all elements of an embodiment of the apparatus of the invention are shown.) Roll 7 is shown in two positions (7*a* and 7*b*, respectively). Rolls 6 and 10 are rotatably mounted on horizontally movable carriage 20 and are separated from each other by about the diameter of roll 7. Roll 24 is rotatably mounted above the filament takeoff point from beam 4 and directs filaments 5 to roll 6 so that movement of carriage 20 does not significantly affect the approach angle of the filaments to roll 6 nor, therefore, filament tension. Carriage 20 is supported by low-friction elements 21 on fixed support 22 and can move in the directions shown by arrow 23 in response to changes in filament tension. Low-friction elements 21 can be wheels, bearings, and the like. Fixed support 22 can be a pair of tracks along which low-friction elements 21 can move. Alternatively, fixed support 22 can be a perforated surface through which compressed air can be passed, and low-friction elements 21 can be absent so that carriage 20 is supported on a bed of compressed air. In the embodiment of FIG. 7, movement of carriage 20 in response to changes in filament tension keeps wrap angle at about 180° as arm 8 (shown at two positions 8*a* and 8*b*) pivots through angle θ, thus maximizing the effect of the weights of arm 8 and roll 7 in controlling filament tension.

The advantage of keeping wrap angle close to 180° is that the filament tension can then be better controlled throughout a range of tensions. This can be illustrated by the following example, in which the simplifying assumption is made that the dancer roll is suspended by the filaments between two fixed rolls (mounted at the same height). The tension T applied to the filaments at the dancer roll can be calculated from $$T = \frac{W}{2 \times \cos(1/2 \times [180° - \psi])}$$

wherein W is the (constant) sum of the weights of the dancer roll and arms experienced by the filaments, and [180°−ψ] is the angle between the filaments as they approach and depart roll 7. The variation which is permissible in ψ without changing the tension by more than, for example, 5%, varies with the starting value of ψ, as shown in the Table:

TABLE

| Starting ψ | Maximum Change in ψ |
|---|---|
| 180° | 36° |
| 170° | 28° |
| 160° | 22° |
| 150° | 17° |
| 140° | 14° |
| 130° | 11° |
| 120° | 9° |

Starting angles between those given in the left-hand column will of course be restricted to maximum changes between those given in the right-hand column. The Table shows that the maximum change permissible in ψ becomes increasingly limited as ψ deviates from 180°, thereby reducing the ability of the apparatus to keep the tension constant at a range of tension levels.

The axes of rolls 2 and 3 are parallel to each other in order to rotate beam 4 properly. It is preferred that the axes of rolls 6, 7, and 10 be parallel to one another to keep straight the path taken by the filaments. If for some reason it is desired to direct the plurality of filaments away from such a straight path, for example if the apparatus is to be mounted at an angle to the downstream processing equipment, the axis of the roll positioned at the point of redirection of the filaments can be made perpendicular to the plane defined by a chosen filament as the filament approaches and leaves the roll; this would result in the axis of the roll at the point of filament redirection not being parallel to the axes of the other rolls.

Various means of signalling the position of arms 8 to start and stop the rotation of driven roll 2 are possible. In the embodiment illustrated in FIGS. 1, 2 and 3, signalling rod 11 is slidably attached to a counterweighted arm 8 by collar 14 and pivotably attached to switch 12. In FIG. 1, rod 11 is shown at only one position corresponding to the approximate middle position of arm 8. The switch can be a limit (on/off) switch, starting the drive means for roll 2 when arms 8 (and therefore rod 11) are raised due to high tension on filaments 5 and stopping the drive means when arms 8 and rod 11 are lowered due to low tension on filaments 5.

Figure 3A:
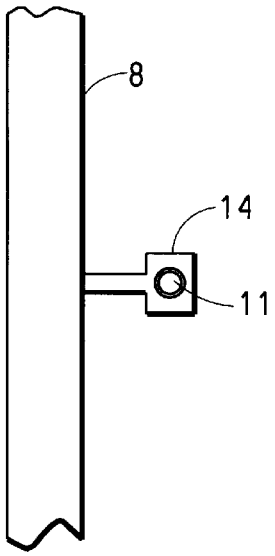
FIG. 3 illustrates in greater detail one embodiment of signaling to a switch the position of an arm on which a dancer roll is mounted.
Figure 3B:
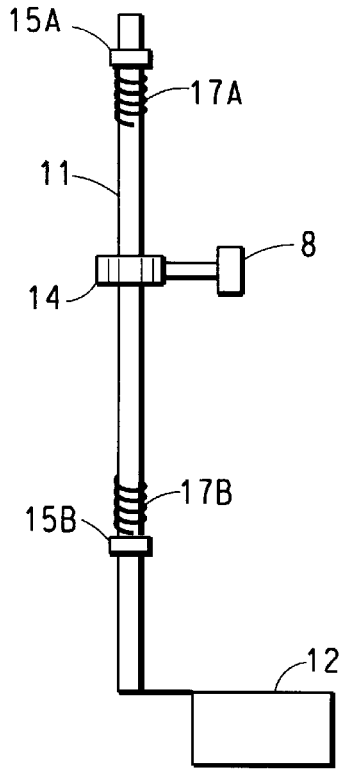

As shown in greater detail in FIG. 3A, rod 11 (shown in cross-section) is slidably mounted on arm 8 by means of collar 14 (also shown in cross-section), which is attached to arm 8; only a segment of arm 8 is shown. FIG. 3B shows arm 8 in cross-section and rod 11 passing through collar 14. Rod stops 15A and 15B, mounted on rod 11, transmit the motion of arm 8 to switch 12 via rod 11 when arm 8 reaches a predetermined limit of travel defined by the position of the rod stops. When collar 14 reaches either spring 17A or 17B, the spring is compressed against stop 15A or 15B, causing rod 11 to move, which in turn activates or deactivates switch 12. Alternatively, rod 11 can be pivotably attached to arm 8 and slidably attached by a collar attached to switch 12, with rod stops on the rod on either side of the collar. This type of arrangement permits some "play" in the connection between arm 8 and switch 12 so that frequent small movements in arm 8 do not result in excessively frequent starting and stopping of the drive means, driven roll 2, and, as a consequence, beam 4. The rod stops can be moved along the length of rod 11 so that the degree of free movement ("play") can be adjusted. One way of permitting such adjustment is to make stops 15 threaded and rod 11 at least partially threaded, as in a nut-and-bolt combination, without letting the threads on rod 11 interfere with the movement of the rod though collar 14. Springs 17A and 17B protect switch 12 from physical damage as arm 8 and rod 11 rise and fall.

Optional beam guides 18A and 18B (see FIG. 2) prevent the beam from slipping out of position along rolls 2 and 3.

Other conventional, optional items can also be used with the present apparatus. An empty beam sensor can be added to alert an operator that the beam is empty and/or to stop downstream processing. Such a sensor can comprise a conductive spring wire held against the filaments on the beam. When the beam becomes empty, the wire contacts the beam, closes an electrical circuit to ground, and the downstream operation is signalled to stop. A high filament tension detector, for example comprising a conductive wire positioned so that arm 8 can touch the wire at a preselected high position of the arm, thus closing an electrical ground circuit, can be used to alert the operator that filament tension is too high and/or to stop downstream processing. This is especially effective when the beam is empty and the filaments, which are typically taped to the beam at the core, can no longer be unwound.

A photoelectric cell system can be used in place of the collar and rod signalling combination exemplified in the Figures. For example, light can be sent from one A-shaped frame section to a photoelectric cell on the other A-shaped section so that, when the light is interrupted by arm 8, a signal is sent to activate or deactivate the switch. A similar system can be used as a high filament tension sensor.

Figure 4:
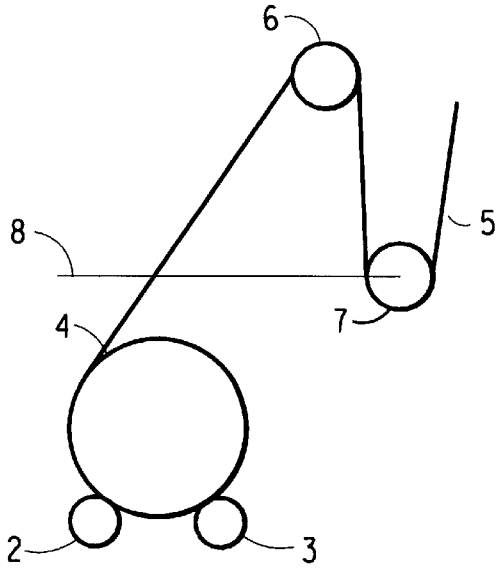
Figure 5A:
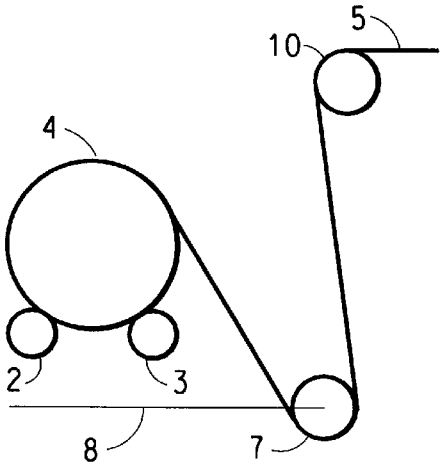
Figure 5B:
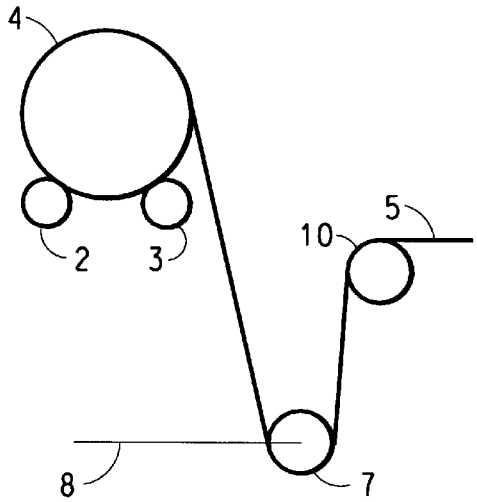
Figure 6:
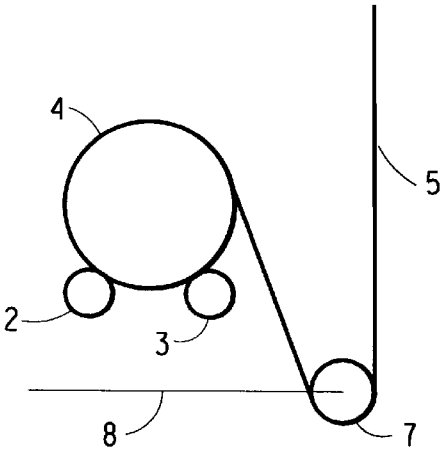

Although it is preferred that the apparatus include idler rolls 6 and 10, such rolls are optional. A less preferred embodiment of the apparatus in which roll 10 is omitted is shown schematically in FIG. 4; for clarity, the frame and other elements of the apparatus are not shown. In FIG. 4, optional roll 6 (the second idler roll in this embodiment) is higher than dancer roll 7, and rolls 2 and 3 and beam 4 are shown lower than arm 8 and roll 7. When roll 6 is omitted, as in FIGS. 5A and 5B, rolls 2 and 3 and beam 4 can be higher than both roll 7 and roll 10 (the second idler roll in this embodiment) (FIG. 5B) or at a height between the heights of rolls 7 and second idler roll 10 (FIG. 5A). When neither roll 10 nor roll 6 is used, as shown schematically in FIG. 6, rolls 2 and 3 are mounted so that beam 4 is always higher than dancer roll 7. Roll 10 is not necessary when the takeup for filaments 5 at the downstream processing equipment is higher than dancer roll 7, as indicated in FIGS. 4 and 6. Roll 6 is unnecessary when dancer roll 7 can be positioned lower than beam 4, as in FIGS. 5A, 5B, and 6. Suitable adjustments can be made in the counterweights and apparatus geometry for optimum performance with the variety of roll configurations described herein.

Referring now to FIG. 1, in one of the processes of carrying out this invention, beam 4, on which filaments 5 have been wound, is laid on driven roll 2 and first idler roll 3. Filaments 5 are passed from the beam, over second idler roll 6, under dancer roll 7, through a wrap angle in the range of 140° to 180° preferably 160° to 180°, over third idler roll 10, and thence to a downstream operation such as knitting and weaving. As the downstream process is started and puts tension on filaments 5, arms 8 are pulled up by the filaments. Rod 11 is thereby raised, and on/off switch 12 is activated. The switch in turn activates the drive means for driven roll 2, which begins to turn beam 4, thereby unwinding filaments 5 from the beam. As the filaments are unwound, the tension in the filaments is reduced, and arms 8 drop. The beam is rotated at a speed that unwinds filaments slightly faster than the downstream process requires and, therefore, to compensate for the excess yarn length caused by the speed difference and still keep yarn tension substantially constant, swing arms 8 drop increasing the yarn length. When arms 8 drop far enough to lower rod 11, switch 12 is deactivated. As a result, the drive means, driven roll 2, and beam 4 stop. Because filaments are no longer being unwound, the tension (and arms 8 and roll 7) begin to rise again. This cycle continues until the filaments have been entirely unwound from the beam. Weights 9A and 9B on arm 8 can be adjusted to set the average tension applied by roll 7 to filaments 5.

During operation, the elastomeric nature of the filaments and the weight of roll 7 and arms 8 maintain constant tension on the filaments, smoothing out the effects of slight changes in downstream demand and/or release from beam 4, thus avoiding the need for proportional control and its associated cost and the danger of over-control and system oscillation. For example, a beam of 252 ends of 930 decitex Type 141 Lycra® spandex (a registered trademark of E. I. du Pont de Nemours and Company) can be unwound with the present apparatus at about 20 grams total tension and a tension variation of +/−0.5 gram. With even lower friction in the moving parts of the present apparatus, it is expected that even greater tension uniformity would be attainable.

What is claimed is:

1. A beam let-off apparatus for elastomeric filaments comprising:

a frame;

a driven roll and an idler roll rotatably mounted on the frame for rotatably supporting a beam on and between the driven roll and the idler roll;

a dancer roll rotatably mounted between arms mounted on the frame, for passing the filaments under and around the dancer roll through a wrap angle in the range of 140° to 180°;

drive means for rotating the driven roll;

a switch for activating and deactivating the drive means; and means for signalling dancer roll position to the switch so that when the dancer roll is in a raised position the switch activates the drive means, and when the dancer roll is in a lowered position the switch deactivates the drive means.

2. The apparatus of claim 1 wherein the arms are pivotably mounted on the frame lower than the center of the beam and the dancer roll has a non-rotational motion which is substantially vertical.

3. The apparatus of claim 2 wherein the wrap angle is in the range of 160° to 180°, the switch is an on/off switch, the arms pivot about a substantially horizontal position in response to changes in filament tension, and further comprising a second idler roll rotatably mounted on the frame higher than the dancer roll.

4. The apparatus of claim 1 wherein the arms are pivotably mounted on the frame higher than the center of the beam, the dancer roll has a non-rotational motion which is substantially vertical, and further comprising a second idler roll rotatably mounted on the frame higher than the dancer roll.

5. The apparatus of claim 4 wherein the wrap angle is in the range of 160° to 180°, the arms pivot about a substantially horizontal position in response to changes in filament tension, the switch is an on/off switch, and further comprising a third idler roll rotatably mounted on the frame higher than the dancer roll.

6. The apparatus of claim 5 wherein the arms are counterweighted, the signalling means is a collar-and-rod combination which is adjustable with rod stops and further comprising an empty-beam sensor, a pair of beam guides, and a high filament tension detector.

7. A method for letting off a plurality of elastomeric filaments from a beam comprising the steps of:

(a) providing a frame;

(b) rotatably supporting a beam on and between a driven roll and an idler roll rotatably mounted on the frame so that the filaments are unwound from the beam when the driven roll is rotated;

(c) passing the filaments under and around a dancer roll through a wrap angle in the range of 140° to 180°, the dancer roll being rotatably mounted between arms mounted on the frame;

(d) providing drive means for rotating the driven roll;

(e) providing a switch for activating and deactivating the drive means; and (f) signalling dancer roll position to the switch so that when the dancer roll is in a raised position the switch activates the drive means, and when the dancer roll is in a lowered position the switch deactivates the drive means.

8. The method of claim 7 utilizing arms that are pivotably mounted on the frame lower than the center of the beam and a dancer roll whose non-rotational motion is substantially vertical.

9. The method of claim 8 utilizing an on/off switch, a second idler roll rotatably mounted on the frame higher than the dancer roll, and arms that pivot about a substantially horizontal position, wherein the filaments are passed through a wrap angle in the range of 160° to 180°, and further comprising an additional step after step (c) of passing the filaments over said second idler roll.

10. The method of claim 7 utilizing arms that are pivotably mounted on the frame higher than the center of the beam, a second idler roll rotatably mounted on the frame higher than the dancer roll, and a dancer roll whose non-rotational motion is substantially vertical, and further comprising an additional step before step (c) of passing the filaments over said second idler roll.

11. The method of claim 10 utilizing arms that pivot about a substantially horizontal position, an on/off switch, and a third idler roll rotatably mounted on the frame higher than the dancer roll, and wherein the filaments are passed over said second idler roll through a wrap angle in the range of 160° to 180° and then over said third idler roll.

* * * * *